United States Patent [19]

von der Eltz et al.

[11] 4,433,976

[45] Feb. 28, 1984

[54] PROCESS FOR THE SEMICONTINUOUS DYEING OF TUBULAR KNITTED FABRICS OF CELLULOSE FIBERS WITH AZO DEVELOPING DYESTUFFS

[75] Inventors: Hans-Ulrich von der Eltz, Frankfurt am Main; Peter Heinisch, Kelkheim; Hans J. Ballmann, Frankfurt am Main, all of Fed. Rep. of Germany

[73] Assignee: Hoechst AG, Frankfurt am Main, Fed. Rep. of Germany

[21] Appl. No.: 391,858

[22] Filed: Jun. 24, 1982

Related U.S. Application Data

[63] Continuation of Ser. No. 288,016, Jul. 29, 1981, abandoned.

[30] Foreign Application Priority Data

Jul. 30, 1980 [DE] Fed. Rep. of Germany ..... 3028843

[51] Int. Cl.[3] ..... D06P 1/12; D06P 3/68

[52] U.S. Cl. ..... 8/555; 8/666; 8/918

[58] Field of Search ..... 8/555, 666, 918

[56] References Cited

U.S. PATENT DOCUMENTS

| | | | |
|---|---|---|---|
| 3,713,767 | 1/1973 | Lowenfeld et al. | 8/666 |
| 4,304,567 | 12/1981 | Ballmann et al. | 8/543 |
| 4,323,363 | 4/1982 | Brachten et al. | 8/532 |

FOREIGN PATENT DOCUMENTS

| | | |
|---|---|---|
| 50-52381 | 5/1975 | Japan . |
| 55-51884 | 4/1980 | Japan . |
| 1523408 | 8/1978 | United Kingdom . |
| 2003196 | 3/1979 | United Kingdom . |
| 2007238 | 5/1979 | United Kingdom . |

*Primary Examiner*—A. Lionel Clingman

*Attorney, Agent, or Firm*—Curtis, Morris & Safford

[57] ABSTRACT

In the dyeing of cellulose knitted fabrics in hose form, according to a two-bath procedure, with azo dyes produced on the fiber by coupling of their formation components, it was hitherto impossible on an industrial scale to forward the developing liquor in a sufficiently rapid manner into the interior of the textile hose, after impregnation of said tubular goods in a winch beck using the exhaust technique. Dyestuff development without intermediate drying was impeded by the insufficient liquor uptake of the flattened textile material that had previously been impregnated on subsequent slop-padding wet-in-wet with the developing liquor.

By incorporation of an auxiliaries' combination comprising homo- or copolymers of acrylic acid amide and a wetting agent in said developing liquor, the liquor uptake thereof by the moist fiber material is increased and the penetration rate of this liquor during the coupling is incited in such a manner that textile hoses which exhibit even, well penetrated dyeings are obtained.

Dyeing of tubular knitted fabrics, especially in hose form, with azo developing dyes has become safe only in accordance with this invention.

8 Claims, No Drawings

PROCESS FOR THE SEMICONTINUOUS DYEING OF TUBULAR KNITTED FABRICS OF CELLULOSE FIBERS WITH AZO DEVELOPING DYESTUFFS

This is a continuation of application Ser. No. 288,016 filed July 29, 1981, now abandoned.

The present invention relates to the even dyeing of a tubular knitted fabric in hose form and consisting of or containing preponderantly cellulose fibers, especially cotton, with at least one water-insoluble azo dyestuff produced on the fiber according to a semicontinuous method, in which the impregnation is performed by applying onto the hose fabric a coupling component under alkaline conditions using the exhaust technique, then the tubular article so treated is partially dehydrated, and subsequently the development of the dyestuff is effected, wet-in-wet, by slop-padding the textile goods with a diazo component in the presence of an acid and/or an acid-forming substance.

Uniform dyeing of cotton tubular knitted fabrics in hose form with azo developing dyestuffs is extremely difficult especially with respect to the evenness of the dyeings produced according to this principle. The problems involved could hitherto be solved only partially. Especially interlock fabrics nearly cannot be dyed even in this manner, because at the start of dyestuff formation from coupling and diazo component non-uniform coupling conditions arise due to the compactness of the wet textile material and the higher speed of ionic reactions than that of the coupling reaction, which situation becomes ultimately manifest in the form of uneven dyeings. Such deterioration of the dyeing result occurs above all when operating with the use of a winch beck, and this to such an extent that there takes place no dyestuff coupling at all at some places of the goods.

Attempts have therefore been made repeatedly to overcome the drawbacks as ascertained on dyeing of tubular knitted fabrics with azo dyes produced on the fiber; however, these efforts have not succeeded hitherto apart from exceptional cases. Thus, for example, when applying individually chosen combinations of coupling and diazo component, impregnation of the goods with the coupling component is carried out in a winch beck, and developing of the dyestuff by treatment with the diazo component is subsequently performed in specially designed roller becks according to a semicontinuous operation mode. However, this application technique allows dyeing of limited web lengths only, because due to the restricted capacity of roller becks merely a certain developing potential is predetermined which corresponds to the supply of space, and furthermore by reason of the fact that the optimum pH conditions for the coupling phase can be maintained with difficulty only for a prolonged period of time.

In this connection there has been proposed furthermore a one-bath exhaust process for textiles in rope form, according to which an uniform low pH is adjusted on the goods, before addition of the diazo component, by acidification of the otherwise alkaline impregnation bath, so that the subsequent coupling reaction can proceed without any influence of the ionic reaction from changing the pH (German Pat. No. 2,808,909). However, in the industrial practice this known process did not result in satisfactorily even dyeings, either, and moreover, the dye yield, too, was insufficient (naphthols sensitive to acids).

Application of so-called wet-in-wet processes for producing azo dyes on the fiber, that is, development on the padder of an impregnation not subjected to intermediate drying, is impeded by the fact that the quantity of liquor which can be absorbed, in addition, on slop-padding of the goods being still wet from the impregnation step (that is, the additional liquor uptake) is insufficient for dissolving the amount of diazonium compound imperative for developing the dyestuff, and that corresponding to this operation mode the concentration of alkali-binding agent (acetic acid), required for neutralizing the alkali of the impregnation, is at such a high level that it adversely affects the coupling reaction on the surface of the goods where neutralization proceeds first. Moreover, after having impregnated the textile material with the coupling component in a winch beck it was hitherto impossible to forward the developing liquor into the interior of the tubular goods as rapidly as necessary.

It was therefore the object of the present invention to overcome the cited disadvantages on two-bath dyeing of tubular knitted fabrics in hose form wet-in-wet with the components for producing water-insoluble azo dyestuffs on the fiber, especially with respect to insufficient liquor uptake during the slop-padding operation with the developing liquor; that is, to ensure that on padding of wet goods already impregnated with the coupling component such an amount of liquor is applied which is sufficient to dissolve the quantity of diazonium compound required for dyestuff formation, and that the concentration of alkali-binding agent is maintained below the noxious level during the coupling. A further object was to take care for a rapid penetration of the above padding liquor into the fabric, which is mandatory for realizing uniform coupling conditions in the goods.

In accordance with the invention, these objects are achieved by incorporating into the acidic developing liquor containing the diazo component capable of being coupled an auxilieries' combination of a polymeric component selected from the group consisting of homopolymers and copolymers of acrylic acid amide and mixtures of the foregoing, said polymeric component being incorporated in an amount of from 15 to 60 g/l in the form of a 2 to 8, preferably 4 to 5% (by weight) aqueous formulation, and of from 2 to 20 g/l of an anionic or nonionic wetting agent.

Suitable homopolymers or copolymers of acrylic acid amide are, for example:

(a) linear or branched homopolymers of acrylic acid amide;

(b) copolymers of acrylic acid amide and semiesters of maleic acid with polyglycol ethers of natural or synthetic fatty alcohols of from 12 to 18 carbon atoms with 5 to 10 mols of ethylene oxide per mol of fatty alcohol, in the weight ratio of from 1:0.05 to 1:0.5, calculated on the acrylic acid amide;

(c) copolymers of acrylic acid amide and acrylamido-lower alkane-sulfonic acid in the weight ratio of from 1:0.05 to 1:0.5, calculated on the acrylic acid amide;

(d) copolymers of acrylic acid amide and N-vinyl-N-methylacetamide in the weight ratio of from 1:0.05 to 1:0.5, calculated on the acrylic acid amide;

(e) mixtures of the polymers specified under (a) to (d) above among one another and optionally in combination with ε-caprolactam in the weight ratio of from 1:0.5 to 1:1, calculated on the polymers.

The homopolymers of acrylic acid amide or the copolymers thereof with the other monomers cited sub (a) through (e) have a molecular weight of from $1.0\times10^6$ to $2.5\times10^6$, preferably $1.5\times10^6$ to $2.0\times10^6$.

Surprisingly the specific properties of the above acrylic acid amide polymers having about an increased liquor pick-up at the same roll pressure (in bar/cm$^2$). This effect is about proportional to the applied amount of the polymer products, i.e. the higher the concentration applied, the greater the increase of liquor pick-up within a technically justifiable range (in accordance with the recommended concentration of the polymers added).

The assistance of homopolymers and copolymers of acrylic acid amide and a wetting agent according to the invention takes favorably effect upon the dyestuff formation in that the liquor uptake by the goods during the slop-padding operation, wet-in-wet, with the developing bath is increased and that the penetration through the double-lapped textile material is incited in such a manner that even and completely dyed-through textile hoses are obtained.

It was remarkable to observe that according to the novel mode of proceeding liquor uptake rates of additional 50 to 130% (of the weight of the dry goods), depending on setting of the rolls and efficiency of the padder used, are attained on the textile hoses; that is, as the final result a total liquor uptake of 120 to 200 weight % in the case where on the knitted fabric so treated about 70 weight % of moisture had already been present, due to the impregnation using the exhaust process and prior to the padding for developing the azo dye. This liquor amount which is additionally available now permits to dissolve the diazonium compound in the necessary quantity, and the concentration of alkali-binding agent is thus kept pending within the usual limits. Furthermore, the wetting agent ensures rapid distribution of the padding liquor in the fabric, thus resulting in uniform dyestuff formation on the fiber.

It could not be expected that by the use of the combination of auxiliaries in accordance with the invention, while maintaining all other conditions unchanged, the liquor uptake in the course of the (second) padding experiences raising by about 70 weight % as compared to a padding liquor without these additives, and that, even on already wet goods, still an increase of liquor uptake may be obtained, thus but now making possible to apply the required amount of diazo component onto the impregnation.

Moreover, from the increased liquor uptake results that irregularities present on the textile material immediately after having left the padder be balanced by diffusion, so that marks originating from squeezed edges of the fabric hose do not appear. Thus, a further drawback occurring in the attempts made as described above is removed, likewise.

By means of the process of the invention it is allowed for the first time to dye also voluminous material in the form of a hose corresponding to a two-bath operation with the components for producing water-insoluble azo dyestuffs on the fiber, in a uniform and even manner and without intermediate drying. The disadvantages known from the prior art processes as to a wet-in-wet liquor application are now overcome, and a dyeing technique is thus at disposal according to which larger metrages of tubular goods that had previously been impregnated can continuously be conducted to dyestuff developing.

Of the textile materials, there are suitable for the process of the invention tubular knitted fabrics which consist of or contain preponderantly cellulose fibers, especially cotton, that are treated in hose form and for which the uniformity of dyeing is particularly important. In the case of knitted fabrics even unbleached loom-state goods (especially advantageous with very full or covered shades) may be used. Of course, the process of the invention can be applied also in the case of goods in cut-opened form.

For the dyeing of textiles according to the invention those chemical compounds conventional for producing developing dyestuffs and listed in Colour Index, 3rd ed. 1971 as "Azoic Coupling Component" and "Azoic Diazo Component" are considered useful.

Of the polymeric products derived from acrylic acid amide applied in accordance with the invention, some are already known (German Offenlegungsschrift No. 2,542,051, Cassella Aktiengesellschaft), however, they are used for a completely different purpose, namely to suppress the "frosting effect" in the dyeing of polyester fibers with disperse dyestuffs.

The novel process is carried out as follows. In consideration of the intended color depth, the goods-to-liquor ratio applied and the weight of the tubular knitted fabric the textile hose is impregnated in rope form, in a winch beck or jet dyeing apparatus, with a coupling component from an alkaline bath. When taking off the fabric so impregnated from the winch beck or dyeing jet the rope is dehydrated to about 70 to 90 weight % of residual liquor, and then flattened for the padding operation. Subsequently, the pretreated goods are slop-padded as customary on a padder, wet-in-wet, in the presence of an alkali-binding agent (acid or acid-forming substances) with the developing liquor containing a diazo component capable of being coupled; the auxiliaries' combination according to the invention comprising acrylic acid amide polymer and wetting agent being added to this padding liquor in the amounts as indicated.

The required amounts of diazo component and alkali-binding agent are calculated, as in the case of pad-dyeing of intermediately dried goods, according to the ratios indicated by the manufacturers of the diazo component in the directions for use, while taking into consideration the additional liquor uptake.

The following Examples illustrate the invention without limiting its scope in any way, especially with respect to the wetting agents used. Percentages referred to in the Examples are by weight; in the case of wet treatment of textiles these percentages of liquor uptake and residual moisture are relative to the weight of the dry goods.

EXAMPLE 1

A cotton interlock material (60 kg of grey, unbleached goods) in hose form is impregnated in a winch beck, at a goods-to-liquor ratio of 1:20, with the use of an aqueous solution of

- 0.63 g/l of Azoic Coupling Component 32, C.I. No. 37580 (dissolved according to the directions for dissolution in cold state),
- 6 cm$^3$/l of a 32.5% sodium hydroxide solution,
- 3 cm$^3$/l of a protective colloid on the basis of a fatty acid/protein condensation product,
- 2 g/l of a wetting agent consisting of a sodium alkyl-sulfonate and 10% of the addition product of 8 mols of ethylene oxide onto 1 mol of isotridecanol, 3 $cm^3/l$ of a complexing agent on the basis of an ethylene-diamine acetate, and
20 g/l of sodium chloride.

The impregnation of the textile material is performed for 30 minutes at 30° to 35° C. with the above liquor. The goods so treated are then taken off from the winch beck and squeezed off to 70% of residual liquor; subsequently, the hose is flattened for slop-padding.

Thereupon, the dyestuff is developed, without intermediate drying, by treatment of the impregnated textiles on a padder which comprises a two times' dipping and subsequent squeezing with an aqueous developing bath containing
54 g/l of a stabilized diazonium compound of Azoic Diazo Component 51, C.I. No. 37195,
30 g/l of a 4.3% aqueous formulation of a copolymer of acrylic acid amide and 2-acrylamido-2-methyl-propane-1-sulfonic acid, in a weight ratio of 1:0.1, relative to the acrylic acid amide (molecular weight of the copolymer $1.9\times10^6$),
5 g/l of a wetting agent consisting of a sodium alkyl-sulfonate and 10% of the addition product of 8 mols of ethylene oxide onto 1 mol of isotridecanol,
30 $cm^3/l$ of a 60% strength acetic acid and
2 $cm^3/l$ of a dispersing agent consisting of 80% of stearyl alcohol, oxethylated per mol with 25 mols of ethylene oxide, and 20% of a polyethyleneglycol having a molecular weight of 6000.

Despite immediate use of the still wet goods, a further liquor uptake of 80% is the result of the slop-padding operation in this manner.

After an air passage of the goods for 40 seconds, dyestuff coupling is completed by a passage of the dyed material in hot water at 80° C. For the after-treatment of the dyeing as usual, the textile hose is again placed in the winch beck.

After drying, a navy-blue, tubular knitted hose is obtained the dyeing of which is perfectly even and has penetrated well into the fibers.

EXAMPLE 2

50 kg of a bleached cotton interlock material are impregnated in a jet dyeing apparatus, at a goods-to-liquor ratio of 1:10, with an aqueous solution of
2.3 g/l of Azoic Coupling Components 8, C.I. No. 37525 (dissolved according to the directions for dissolution in cold state)
6 $cm^3/l$ a 32.5% strength sodium hydroxide solution
3 g/l of 2-2'-dinaphthylmethane-6,6'-disulfonic acid (sodium salt),
3 g/l of the complexing agent of Example 1,
3 $cm^3/l$ of formaldehyde (30% strength),
0.02 g/l of a defoamer on the basis of silicone oil, and
20 g/l of sodium chloride.

Using this liquor the textile material is impregnated for 30 minutes at 35° C., the rope is then taken off from the jet dyeing apparatus, squeezed to 90% of residual liquor, and flattened for slop-padding.

Thereupon, the wet, impregnated textile rope is treated on a padder, for developing the dyestuff, which comprises a single dipping and subsequent squeezing with an aqueous bath containing
13 g/l of the diazonium compound of Azoic Diazo Component 2, C.I. No. 37005,
45 g/l of a 4.3% aqueous formulation of a linear homopolymer of acrylic acid amide (molecular weight $1.4\times10^6$),
5 g/l of an anionic wetting agent on the basis of a sodium alkylsulfonate,
11 $cm^3/l$ of a 60% strength acetic acid
13 g/l of sodium acetate, and
2 g/l of the dispersing agent of Example 1.

In the course of the slop-padding process an additional liquor uptake of 90%, that is, a total liquor uptake of 180% is achieved despite the high moisture degree already present due to the previous impregnation. For completing the dyestuff formation, the textile material is plaited down after padding, and after 20 to 30 minutes, the dyeing is after-treated as usual in a jet dyeing apparatus. The brilliant orange dyeing so obtained is perfectly even, and the textile hose is fully permeated by the dyestuff.

When the operations for dyestuff development are carried out in analogous manner, but without adding the auxiliaries' combination comprising acrylic acid amide polymer and wetting agent, then an additional liquor uptake by the textiles of 20% only is the result (even at nearly pressureless setting of the padder rolls to 0.4–1 $bar/cm^2$), and an absolutely uneven dyeing is obtained at which, in the interior of the textile hose, the dyestuff starting components are partially not coupled at all.

EXAMPLE 3

120 kg of a boiled cotton fine-rib material in hose form are impregnated for 30 minutes in a winch beck at 30° C., at a goods-to-liquor ratio of 1:15, with an aqueous liquor containing the following ingredients:
1.81 g/l of Azoic Coupling Component 28, C.I. No. 37541 (dissolved according to the directions for dissolution in cold state),
6 $cm^3/l$ of a 32.5% strength sodium hydroxide solution,
3 $cm^3/l$ of the protective colloid of Example 1,
10 g/l of the complexing agent of Example 1, and
20 g/l of sodium chloride.

The impregnation being complete, the textile material so treated is dehydrated to 80% of residual liquor, and subsequently the dyestuff is developed wet-in-wet on a padder, which comprises a two-times' dipping and subsequent squeezing of the flattened hose with a padding bath having the following composition:
13.4 g/l of the diazonium compound of Azoic Diazo Component 32, C.I. No. 37090
8 g/l of sodium acetate,
10 g/l of a 60% strength acetic acid
60 g/l of a 4% aqueous formulation of a copolymer of acrylic acid amide and the maleic acid semiester of a polyglycol ether from the addition product of 8 mols of ethylene oxide onto 1 mol of isotridecanol, in a weight ratio of 1:0.075, relative to the acrylic acid amide (molecular weight of the copolymer $1.47\times10^6$),
5 $cm^3/l$ of a wetting agent on the basis of a sodium alkyl-sulfonate and an oxyethylated isotridecanol.

The additional liquor uptake resulting on slop-padding of the textile hose is 120% in this case. After an air passage of the fiber material for 30 seconds the dyed goods are treated by a passage in hot water at 80° C., for completion of the coupling, and the dyeing is after-treated as usual on the impregnation apparatus.

A well penetrated, even, brilliant red dyeing is obtained on the cotton fine-rib goods.

What is claimed is:

1. In a process for the even dyeing of a tubular knitted fabric in hose form and consisting of or containing preponderantly cellulose fibers, with at least one water-insoluble azo dyestuff produced on the fiber according to a semicontinuous method, in which the impregnation is performed by applying onto the hose fabric a coupling component under alkaline conditions using the exhaust technique, and the tubular article so treated is then only partially dehydrated and subsequently the development on the dyestuff is effected, wet-on-wet, by slop-padding the textile goods with a developing liquor containing diazo component in the presence of an acid and/or an acid-forming substance, the improvement which comprises incorporating into the acidic developing liquor containing the diazo component capable of being coupled, a combination of a polymeric component selected from the group consisting of homopolymers and copolymers of acrylic acid amide and mixtures thereof, said polymeric component being incorporated in an amount of from 15 to 60 g/l in the form of a 2 to 8% by weight aqueous formulation, and of 2 to 20 g/l of an anionic or nonionic wetting agent.

2. A process as claimed in claim 1, wherein said polymeric component is selected from the group consisting of linear homopolymers and branched homopolymers of acrylic acid amide.

3. A process as claimed in claim 1, wherein said polymeric component is selected from the group consisting of copolymers of acrylic acid amide and semiesters of maleic acid with polyglycol ethers produced from natural or synthetic fatty alcohols of from 12 to 18 carbon atoms and from 5 to 10 mols of ethylene oxide per mol of fatty alcohol, in a weight ratio of from 1:0.05 to 1:0.5, calculated on the acrylic acid amide.

4. A process as claimed in claim 1, wherein the polymeric component is selected from the group consisting of copolymers of acrylic acid amide and acrylamido-lower alkane sulfonic acid in a weight ratio of from 1:0.05 to 1:0.5, calculated on the acrylic acid amide.

5. A process as claimed in claim 1, wherein said polymeric component is selected from the group consisting of copolymers of acrylic acid amide and N-vinyl-N-methylacetamide in a weight ratio of from 1:0.05 to 1:0.5, calculated on the acrylic acid amide.

6. A process as claimed in claim 1, wherein the polymeric component is a mixture of said homopolymers, a mixture of said copolymers or a mixture of one or more of said homopolymers and one or more of said copolymers.

7. A process as claimed in claim 1, wherein to said polymeric component ε-caprolactam is added in a weight ratio of from 1:0.5 to 1:1, calculated on the weight of the polymeric component.

8. A process as claimed in claim 1, wherein the polymeric component has a molecular weight of from $1.0\times10^6$ to $2.5\times10^6$.

* * * * *